United States Patent [19]

Leskovec, Jr.

[11] 4,012,857

[45] Mar. 22, 1977

[54] MEANS FOR INCORPORATING MULTIPLE FIRST DAYS OF ISSUE STAMPS

[76] Inventor: John Leskovec, Jr., 79 Morningside Drive, Elmira, N.Y. 14905

[22] Filed: Dec. 17, 1975

[21] Appl. No.: 641,680

[52] U.S. Cl. ..... 40/2 B

[51] Int. Cl.[2] ..... A41C 3/00

[58] Field of Search ..... 206/39, 459, .84, .83; 150/34, 41; 283/1 B; 229/69–71, 92, 92.8; 40/152, 158 R, 2 B

[56] References Cited

UNITED STATES PATENTS

| | | | |
|---|---|---|---|
| 1,988,909 | 1/1935 | Mackinnon | 229/70 |
| 3,371,851 | 3/1968 | Silene et al. | 206/.83 X |
| 3,692,233 | 9/1972 | Carter, Jr. | 229/71 |
| 3,708,107 | 1/1973 | Williams | 229/69 |
| 3,830,422 | 8/1974 | Dunn | 229/71 |

*Primary Examiner*—Louis G. Mancene
*Assistant Examiner*—John H. Wolff
*Attorney, Agent, or Firm*—Shoemaker and Mattare, Ltd.

[57] ABSTRACT

A means for placing multiple first day of issue stamps, postmarks, description, the words "First Day of Issue" and art work on a sheet of paper, sheets of paper or a roll of paper. The paper can be fan-folded or rolled.

8 Claims, 4 Drawing Figures

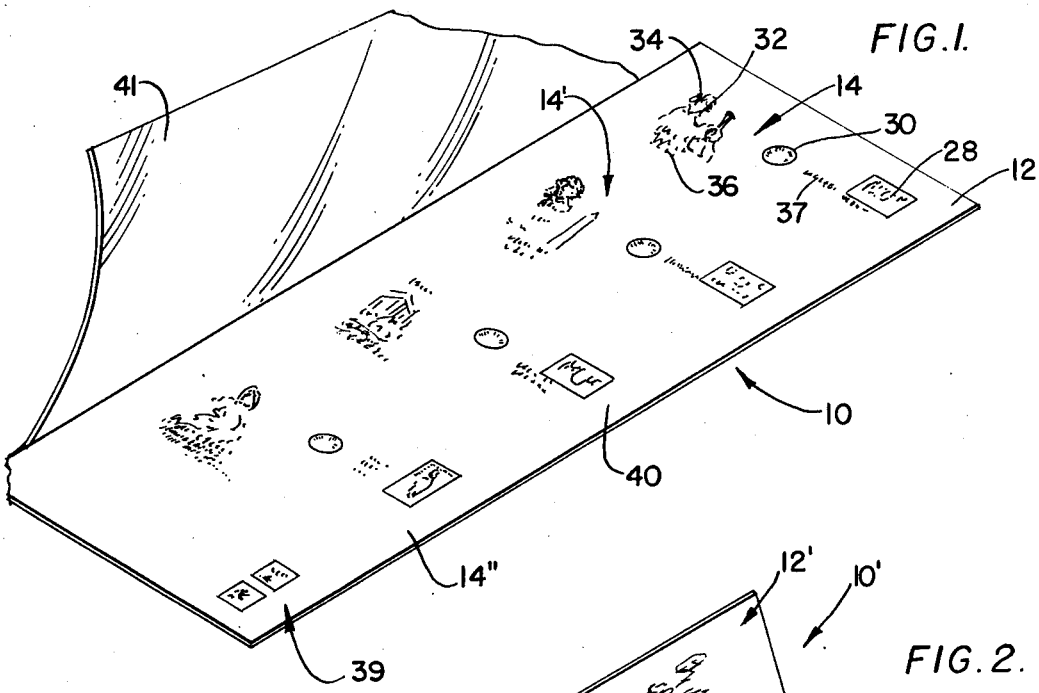
FIG. 1.
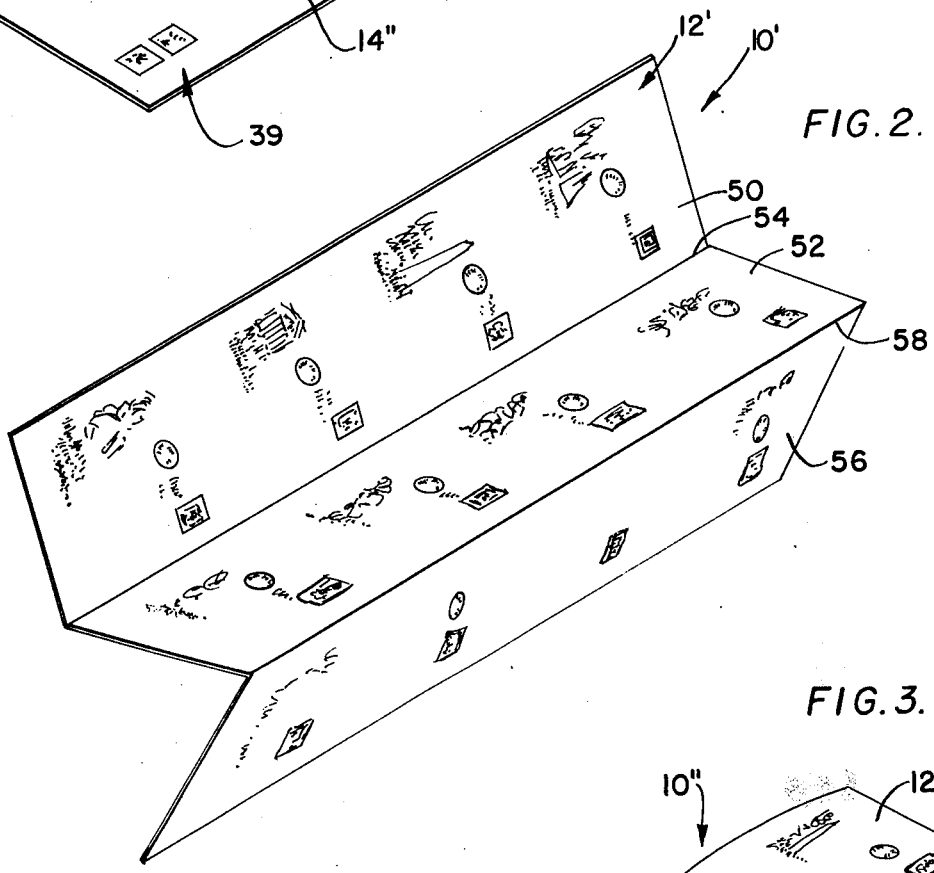
FIG. 2.
FIG. 3.
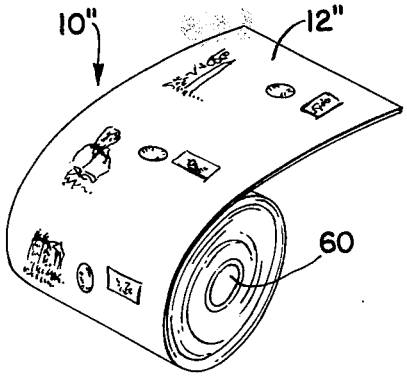
FIG. 4.
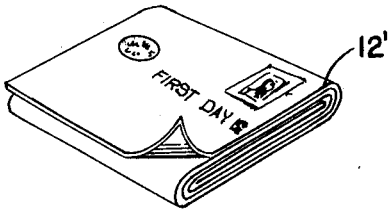

MEANS FOR INCORPORATING MULTIPLE FIRST DAYS OF ISSUE STAMPS

BACKGROUND OF THE INVENTION

The present invention relates to stamp collecting and, more particularly, to first-day mail covers.

Most specifically, the present invention relates to means for having two or more units of a series of first-day covers. Each unit comprises a stamp, postmark indicating where the stamp is first issued, the words "First Day of Issue," a cancellation of the stamp, art work and a description. A series of first-day covers are all affixed to one sheet of paper, that is to say, all stamps are directly affixed to the same sheet of paper, the postmarks, art work, description, the words "First Day of Issue" are all imprinted on the same sheet of paper and the cancellation is partly on the sheet of paper and partly on each stamp for purposes of cancelling each stamp on each first-day cover.

Stamp collecting is one of the most popular hobbies in the United States, and there are many stamp collectors who collect first-day covers. A first-day cover is an envelope or sheet of paper bearing a stamp and the words "First Day Cover" with a postmark of a Post Office where the stamp is first issued and a postal cancellation of the stamp. Often art work and/or descriptive material is included on the envelope or sheet of paper characterizing an event and/or a personage which is commemorated by the particular postage stamp.

Presently, collectors send in to the appropriate Post Office by means of an envelope and the prescribed charge for the stamp desired, a request for the stamp desired. The Post Office Department, in turn, affixes the new stamp on that envelope, cancels the stamp with ink, places the postmark of the city or village where the stamp is issued, and the words "First Day of Issue" with the cancellation on the envelope. The envelope is then mailed to the person requesting the first day of issue service. The envelope is used because it is a means of mailing the first-day cover.

Some postage stamp collectors request groups of two, three, or four stamps or first-day covers for a particular first-day issue. However, the procedure of procuring a first-day cover must be repeated each time a new stamp is issued. This presents problems for both the stamp collector and the Post Office. For example, the collector must be aware of each new issue and request same, or risk having an incomplete set. This increases the cost to him as he must purchase separate money orders, fill out purchase requests, and the like. Furthermore, the Post Office must fill many requests almost continuously during the year thereby requiring the Post Office to have manpower and space allocated for such services.

According to the present invention, a series of units of stamps, postmarks, descriptions, art work and the words "First Day of Issue" are placed on a single sheet of paper and stored and sold as a complete set. Each unit may consist of more than one stamp and more than one postmark.

SUMMARY OF THE INVENTION

The device embodying the present invention enables an entire series of first-day covers to be sold at one time.

All first-day covers for a particular series of stamps or for a particular year, or other periodic basis, or series, are placed directly on a continuous strip of paper or sheet of paper. The strip of paper containing the stamps, postmarks, cancellations, descriptions, the words "First Day of Issue" and the art work may be in a fan-folded form or on a roll-type paper of indeterminate length, or other standard-sized paper. All of the first-day covers of a particular series or set are on the sheet of paper, and are stored by the Post Office, person or persons. When the words "First Day Cover" are used herein, it is assumed to mean the unit of a series consisting of a new stamp being issued, the postmark where the stamp is issued, the words "First Day of Issue," and a cancellation partly on the sheet and partly cancelling the stamp; a description of the stamp and art work describing the stamp can also be included, if desired. Units of first-day covers are attached, imprinted or stamped on the same sheet of paper.

At intervals, when first-day covers are issued, collectors can send in requests for the entire series of first-day covers to the Post Office Department, selected Post Offices around the country, person or persons performing this service, and orders can be efficiently filled. Thus, for example, if there are twenty first-day covers in one year, then a single sheet or roll of paper can have all twenty first-day covers mounted thereon.

The resulting benefits to the Post Office Department are, for example, first-day covers can be sold by the Post Office Department in sets at a profit by selling, not only the stamps, but the entire series of stamps with the postmarks indicating the first dates of issue and the art work comprising the description, with the cancellation of the stamp. The Post Office Department or the person or persons handling this procedure further benefit because all of the first-day covers can be made at one time and at one central place with the various dates thereon. For instance, the sets of first-day covers could be made up near the time the last stamp of a series is issued and the collectors would then be able to purchase a full set. Thus, instead of having great volumes of requests for first-day covers at various times of the year and at various Post Offices throughout the country, each operation requiring the affixing of one stamp and one postmark imprinted on an envelope or strip of paper, several stamps and the associated several postmarks could be placed on a single sheet. Perhaps a high-speed machine could be used to perform all the operations in one movement of the machine and turn out completed series of sheets.

The benefit to collectors is that the cost attributed to each first-day cover is reduced because the multiple stamp sheets or continuous sheet can be sold for less as less paper, envelopes and labor are ultimately required. Normally, a collector buys his special envelopes with art work and description imprinted on the envelope, then sends them into a Post Office for processing. The Post Office presently, upon receipt of the envelope and money order for the cost of the stamp, affixes the new stamp on the special envelope and then imprints the postmark showing where the stamp is first issued, the words "First Day of Issue" and cancels the stamp. Collectors are also assured that they will obtain entire and complete series of stamps at one time without risking the possibility of missing certain issues.

In the present concept, the sheet of paper takes the place of the envelope, and the stamp and related material are placed directly on the sheet or roll of paper.

Thus, two or more first-day covers can be incorporated on a single sheet of paper and with all the resulting abovediscussed advantages.

OBJECTS OF THE INVENTION

It is therefore the main object of the present invention to provide means for displaying and selling entire series of first-day covers at one time on a sheet of paper or roll of paper.

It is another object of the present invention to provide means for storing and filing sets of first-day covers.

These together with other objects and advantages which will become subsequently apparent reside in the details of construction and operation as more fully hereinafter described and claimed, reference being had to the accompanying drawings forming part hereof, wherein like numerals refer to like parts throughout.

DESCRIPTION OF THE DRAWINGS

FIG. 1 is one embodiment of a means for displaying multiple first-day covers in accordance with the teachings of the present invention;

FIG. 2 is another embodiment of a means for displaying multiple first-day covers in accordance with the teachings of the present invention;

FIG. 3 is still another embodiment of a means for displaying multiple first-day covers in accordance with the teachings of the present invention; and FIG. 4 is a sheet having thereon a plurality of first-day covers arranged longitudinally on the sheet.

DETAILED DESCRIPTION OF THE INVENTION

Referring to the drawings, shown in FIG. 1 is a first embodiment of a means embodying the present invention. The sheet means is generally denoted by the reference numeral 10 and comprises a sheet 12 having thereon a plurality of first-day covers comprising means 28, 30 and 37 attached, superimposed and imprinted on sheet 12.

As shown in FIG. 1, the display means 10 shows first-day covers 14, 14' and 14'' in a lineal arrangement, however other arrangements can be selected.

The first-day covers can comprise stamps, postmarks, and/or descriptive material or art work, as desired. For example, the first unit comprises a stamp 28 permanently affixed or fastened to sheet 12 in the upper right-hand corner of the first unit, a postmark 30 adjacent thereto on the first-day cover containing the suitable identification usually contained in a first-day cover postmark. The postmark includes markings 37 superimposed or imprinted, over the stamp and first-day cover. The markings also include the words "First Day of Issue" printed adjacent the stamp. Descriptive material 32 on sheet 12 on the left-hand side thereof can also be included. The descriptive material 32 comprises a "cachet" or art work 34 and a written description 36 therebeneath. The art work and written description identify, depict or represent the event and/or personage shown on stamp 28 which is being commemorated by the stamp and first-day cover.

Furthermore, several stamps, postmarks, and/or descriptive materials can be shown on any first-day cover commemorating the same, or different events. Thus, each sheet can contain all sorts of combinations and permutations of the above elements. As an example, the following combinations and permutations are possible:

one or more units of first-day covers in addition to the following possibilities on a single sheet of paper:

one or more different stamps in combination with one or more different postmarks;

one or more different stamps in combination with one or more different descriptions of the stamps;

one or more different postmarks in combination with one or more different descriptions of stamps;

one or more different stamps in combination with one or more different postmarks and one or more different descriptions;

one or more different stamps in combination with one or more postmarks;

one or more different stamps in combination with one or more descriptions of stamps;

one or more different postmarks;

one or more different stamps in combination with one or more different descriptions;

one or more different stamps in combination with one or more different postmarks and descriptions, postmarks and art work.

Furthermore, as shown at 39, one or more stamps for mailing the set can be individually affixed to sheet 12 along with a postmark indicating the date of issue of the complete set issued, or a postmark only may be affixed thereto.

Other alternatives can include the first-day cover combined with additional postmarks, additional descriptions, additional stamps, additional art work, or combinations thereof, all affixed to the same backing sheet. The additions can be different from the first-day cover, as well as from each other, or the additions can be duplicates of those items already on the backing sheet.

It is also noted that a particular series of first-day covers can be attached, superimposed and imprinted on sheet 12 having a particular color. In this manner, filing by the Post Office is facilitated as identification of each series is facilitated. Furthermore, the sheets 12 can assume any size, such as, for example, 8½ by 11 inches or 8½ by 13 inches, and can be manufactured from any suitable material. Furthermore, holes or other means can be placed in sheet 12 to facilitate storage by the collector and/or the Post Office Department. Index tabs can also be placed on sheet 12 to further facilitate filing and/or identification of a particular series of first-day covers.

A margin 40 can surround the first-day covers and can be used for suitable identifying indicia, or further art work as desired. Furthermore, suitable protective covers, such as cover 41, can be extended from sheet 12 to cover the first-day covers and protect same.

Using the sheet means 12, the Post Office Department can issue an entire series of first-day covers at one time, and collectors need only send in one time to receive the entire series. The collector then need not risk having an incomplete series because he missed one or more issues. Both the Post Office Department and the collector save both money and time by having an entire series of first-day covers issued at once and available as a single unit.

Shown in FIG. 2 is a further embodiment of the display means, and is generally denoted by the numeral 10'. The FIG. 2 embodiment comprises a fan-folded sheet 12' having such as leaf 50 attached to leaf 52 along a fold line 54. The leaf 52 is attached to a further leaf 56 along a fold line 58 which is arranged so that leaf 56 folds in a direction opposite to the leaf 50 so that sheet 12′ is folded into a zig-zag configuration, as shown in FIG. 2. Further leaves can be added so that the total sheet 12′ assumes any length which is suitable for storage and/or disbursement. The fold lines can also be formed of perforations so that individual leaves can be separated. Furthermore, the leaves and/or series of leaves can be color coded to identify complete series or individual parts of a complete series. The fan-folded configuration can be used to store the first-day covers in a manner which protects those covers from damage or soiling during storage. The first-day covers can be arranged on the fan-folded sheet 12′ in combinations and/or permutations similar to those identified above in conjunction with the FIG. 1 embodiment. As above, each leaf can comprise a margin, art work, indexing material, or storage facilitating means.

Shown in FIG. 3 is still another embodiment of the display means 10, and is identified by the numeral 10″. The FIG. 3 embodiment comprises a sheet 12″ having an indeterminate length and wound around a mounting means, such as roll 60. Individual series of first-day covers can be superimposed, attached and imprinted on the rolled sheet transversely thereto or longitudinally thereof in accordance with the size of the sheet and/or first-day covers or other considerations. The individual series can be color coded and attached to each other along perforations in the rolled sheet for easy separation. Other convenient indexing indicia, such as index tabs or other marks can also be used. In the rolled configuration, the sheet 12″ is a sheet on which the first-day covers are attached, superimposed and imprinted. The fan-fold and roll arrangements are especially suitable for storing and/or displaying series having numerous cachets.

Alternatively, an individual collector could utilize the basic concept of the present invention to produce a sheet having a series of first-day covers. Thus, for example, a sheet such as 12′ could be utilized in conjunction with a partially cut-away envelope such as shown in U.S. Pat. Nos. 3,062,431 or 174,940. A sheet is folded and inserted into the envelope so that a blank section of the paper is exposed. The envelope is sealed with removable tape, and sent to the appropriate Post Office. At that Post Office the stamp, postmark, and the like is placed on the exposed section of paper and returned to the collector. The sheet can then be refolded to expose a new blank section and the process repeated until a complete series is obtained on a single sheet of paper. The resulting backing sheet is shown in FIG. 4. Alternatively, the envelope could have only a back so that, when removably sealed to that back, the folded paper forms the front thereof.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by those claims.

What is claimed is:

1. A means for displaying first day covers comprising:
a unitary backing sheet sectioned into a plurality of adjacent portions;
a complete set of first day covers including a plurality of units with each unit being located in one of said portions and including a postal stamp permanently affixed to said backing sheet, a post office cancellation mark partly on said stamp and partly on said backing sheet, the words "first day of issue", and a postmark indicating where said stamp was issued, each of said units representing one unit of said complete set of first day covers;
said backing sheet being continuous and uninterrupted throughout the length thereof so that said plurality of first day covers are all mounted on the same sheet.

2. The sheet means of claim 1 wherein said sheet is fan-folded to form a plurality of leaves, and further including a plurality of first-day covers each having a stamp affixed to each of said leaves.

3. The sheet means of claim 1 further including art work representing the item commemorated by at least one of said stamps, said art work being printed on said backing sheet.

4. The sheet means of claim 1 wherein said sheet is in the form of a continuous roll.

5. The sheet means of claim 1 wherein each first-day cover unit further comprises a word description of the event commemorated by said each first-day cover unit.

6. The sheet means of claim 1 further including a protective cover connected to said backing sheet to selectively cover and uncover said backing sheet so that said cover can be placed over said sheet to prevent that sheet from becoming soiled and moved to uncover said sheet for display purposes.

7. The sheet of claim 1 wherein said backing sheet is fan folded.

8. The sheet of claim 1 wherein said backing sheet is in the form of a continuous roll.

* * * * *